US005755601A

United States Patent [19]

Jones

[11] Patent Number: 5,755,601

[45] Date of Patent: May 26, 1998

[54] BRAKE SYSTEM FOR PERSONAL WATERCRAFT

[75] Inventor: James R. Jones, Neosho, Wis.

[73] Assignee: Brunswick Corporation, Lake Forest, Ill.

[21] Appl. No.: 819,692

[22] Filed: Mar. 17, 1997

[51] Int. Cl.[6] ..... B63H 11/11

[52] U.S. Cl. ..... 440/1; 440/41; 440/42

[58] Field of Search ..... 440/1, 41, 42; 60/221; 114/145 R, 170

[56] References Cited

U.S. PATENT DOCUMENTS

| | | | |
|---|---|---|---|
| 3,918,256 | 11/1975 | Ashleman | 440/41 |
| 3,945,201 | 3/1976 | Entringer | 440/41 |
| 4,073,258 | 2/1978 | Logan | 440/41 |
| 5,062,815 | 11/1991 | Kobayashi | 440/41 |
| 5,474,007 | 12/1995 | Kobayashi | 440/42 |
| 5,494,464 | 2/1996 | Kobayaski et al. | 440/41 |

OTHER PUBLICATIONS

"Sport Jet 175XR[2]", Operation & Maintenance Manual 90–10157970, Brunswick Corporation, 1996.

*Primary Examiner*—Sherman Basinger

*Attorney, Agent, or Firm*—Andrus, Sceales, Starke & Sawall

[57] ABSTRACT

A jet propelled watercraft has a brake which the driver of the watercraft can use to decelerate forward motion of the watercraft. The brake mechanism preferably includes a reverse gate that allows watercraft steering to be consistent when the watercraft is accelerating or cruising with the reverse gate in a fill-up position as when the watercraft is decelerating with the reverse gate in a full-down or partial-down position. The positioning of the reverse gate during operation of the watercraft is adjusted in accordance with the state of hand operated actuators for a forward throttle control mechanism and a brake control mechanism. Preferably, an electronic controller receives a signal from the control mechanisms and outputs a control signal that directs a servomotor to move a reverse gate control cable or linkage to position the reverse gate. Forward thrust can be increased by proportionally closing the actuator for the forward thrust control mechanism. In addition, reverse thrust or braking thrust can be increased by proportionally closing the actuator for the brake control mechanism.

31 Claims, 5 Drawing Sheets

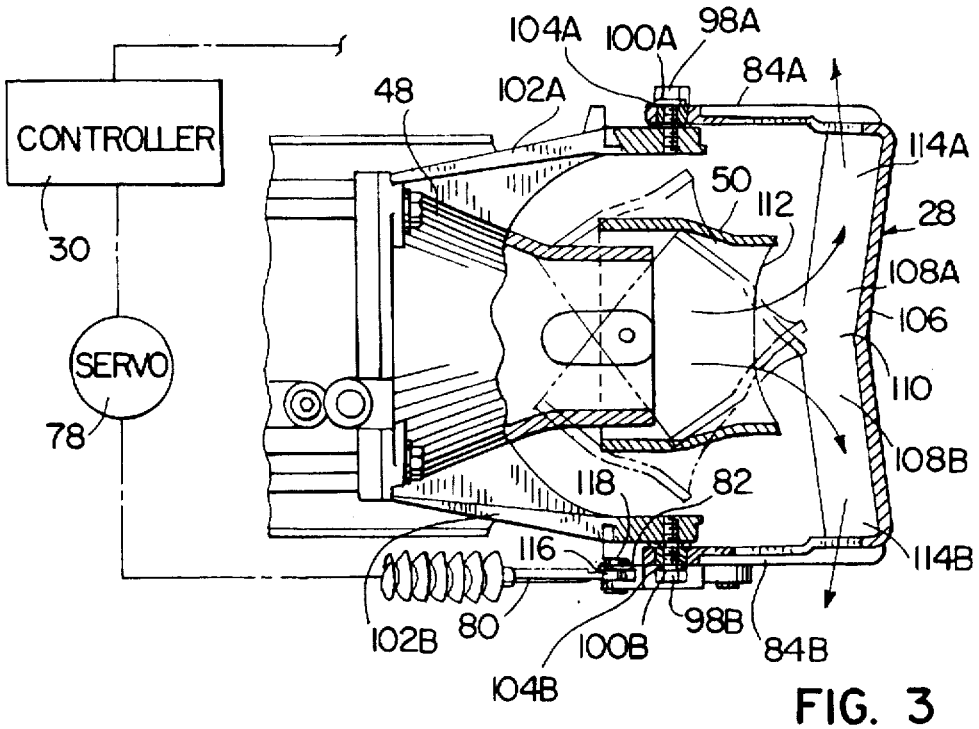
FIG. 3
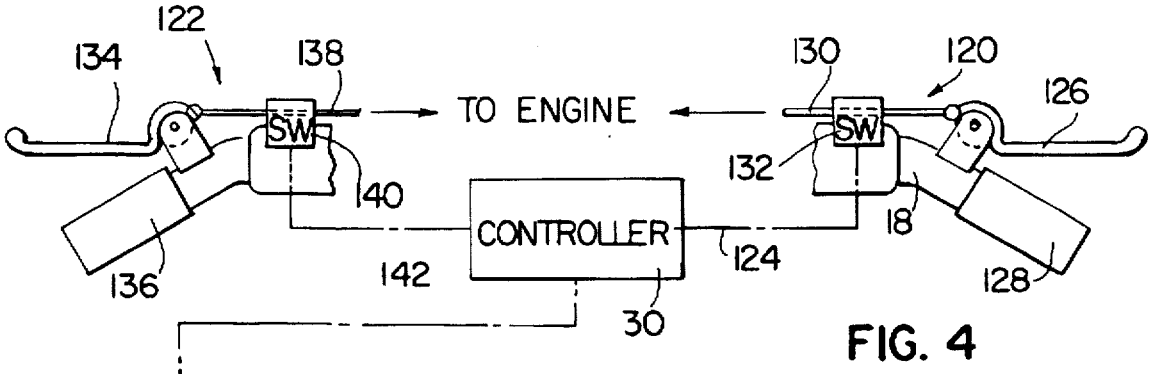
FIG. 4
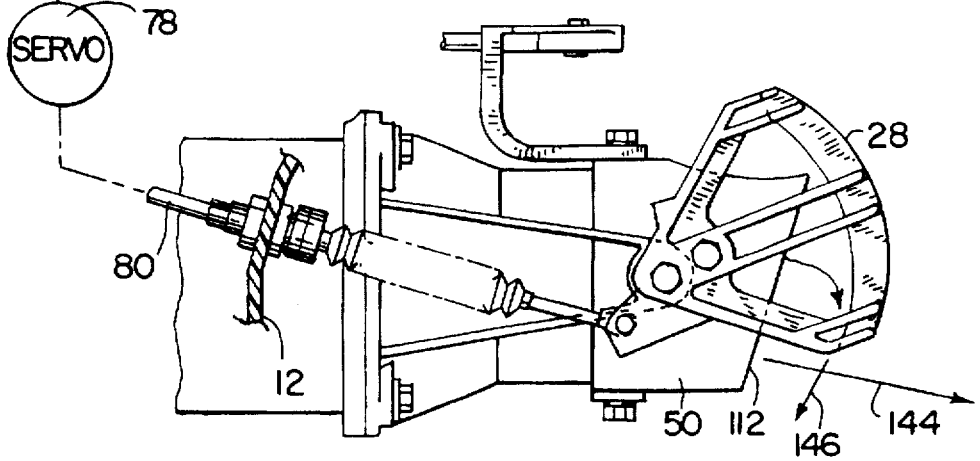

| | FROM | | TO | | EFFECT | |
|---|---|---|---|---|---|---|
| ROW | BR. | TH. | BR. | TH. | | |
| 1 | 0 | 0 | 0 | 1 | Gate Up | Forward Thrust |
| 2 | 0 | 0 | 1 | 0 | Gate Down | Reverse/Brake |
| 3 | 0 | 1 | 0 | 0 | Neutral Position | Neutral |
| 4 | 0 | 1 | 1 | 1 | Neutral Position | Neutral |
| 5 | 1 | 0 | 0 | 0 | Neutral Position | Neutral |
| 6 | 1 | 0 | 1 | 1 | Neutral Position | Neutral |
| 7 | 1 | 1 | 0 | 1 | Gate Up | Forward Thrust |
| 8 | 1 | 1 | 1 | 0 | Gate Down | Reverse/Brake |
| 9 | 0 | 1 | 1 | 0 | Gate Down | Reverse/Brake |
| 10 | 0 | 0 | 1 | 1 | Neutral Position | Neutral |
| 11 | 1 | 0 | 0 | 1 | Gate Up | Forward Thrust |
| 12 | 1 | 1 | 0 | 0 | Neutral Position | Neutral |

FIG. 8

BRAKE SYSTEM FOR PERSONAL WATERCRAFT

FIELD OF THE INVENTION

The invention relates to jet propelled watercraft, and in particular to a brake mechanism and control system.

BACKGROUND OF THE INVENTION

Jet propelled personal watercraft are propelled forward by discharging a jet of water rearward from the watercraft through a nozzle. A tubular rudder is mounted to the nozzle to pivot vertically, and can be turned to deflect the jet of water and steer the watercraft accordingly. A reverse gate can be positioned rearward of the rudder to deflect at least a portion of the jet forward and under the watercraft. When the reverse gate is in the full-up position and the watercraft is moving forward, the rudder is turned to deflect the jet towards port to turn the watercraft towards port. Likewise, the watercraft turns toward starboard when the rudder is turned to deflect the jet of water toward starboard.

In order to use the reverse gate to provide a brake for the watercraft when the watercraft is moving in the forward direction, the reverse gate in conjunction with the other components of the pump should embody several characteristics. It is important that the steering direction and characteristics be consistent when the watercraft is accelerating with the reverse gate in the full-up position as when the watercraft is decelerating with the reverse gate in a full-down or a partial-down position. Such a reverse gate is disclosed in copending patent application, Ser. No. 08/783,440 filed Jan. 16, 1997 entitled "Reverse Gate for Personal Watercraft", by James R. Jones, Peter Grinwald and Richard Christians, and assigned to the assignee of the present application. For effective braking, it is also important that there is not excessive reverse thrust when the watercraft is traveling at high speeds in the forward direction. If this occurs, it is typical for the aft portion of the watercraft to rise and the bow to drop. Under extreme conditions, some watercraft may even become unstable while using the reverse gate to brake at high forward speeds.

BRIEF SUMMARY OF THE INVENTION

The present invention was conceived during ongoing developmental efforts by the assignee with respect to reverse mechanisms and brakes for personal watercraft. The invention provides an effective, easy to use braking system for a personal watercraft in which the steering characteristics of the watercraft in a deceleration mode are similar to the steering characteristics of the watercraft in a cruising or acceleration mode.

In addition to using a reverse gate that is designed to provide steering characteristics for the watercraft when the reverse gate is in the fully down position (or neutral position, or partially down position) that is similar to when the reverse gate is in the full-up position, a control system is provided to shift the position of the reverse gate between full-up, neutral, full-down, and perhaps even partial-down positions, depending on the driver's actuation of a forward throttle control mechanism and a brake control mechanism.

The invention includes a forward throttle control mechanism that throttles the engine and also outputs a forward throttle signal to an electronic controller. The invention also includes a separate brake control mechanism that throttles the engine and outputs a brake signal to the electronic controller. In response to these signals, the electronic controller outputs a reverse gate control signal that controls a motor to mechanically move a reverse gate control cable and position the reverse gate in accordance with the reverse gate control signal.

It is preferred that the forward throttle control mechanism and the brake control mechanism each include an actuator comprising a hand lever mounted on the handlebar of the steering assembly for the watercraft. As an operator squeezes the hand lever for the brake control mechanism harder, the brake control mechanism increases throttle to the engine, preferably by mechanically moving a secondary throttle cable. In this manner, an operator of the watercraft can proportionally increase braking thrust by squeezing the actuator harder.

Other features and advantages of the invention may be apparent to those skilled in the art upon reviewing the following drawings and description thereof.

BRIEF DESCRIPTION OF THE DRAWINGS

FIG. 3 is a top view of the rear portion of the jet pump shown in FIG. 2 with the reverse gate in the full-down position.

FIG. 4 is a schematic drawing illustrating the brake mechanism with the actuator for the brake mechanism in a fully open position and an actuator for the forward throttle mechanism in a fully open position.

FIG. 8 is a table illustrating the preferred control scheme for the electronic control unit to control the brake mechanism.

DETAILED DESCRIPTION OF THE INVENTION

Figure 1:
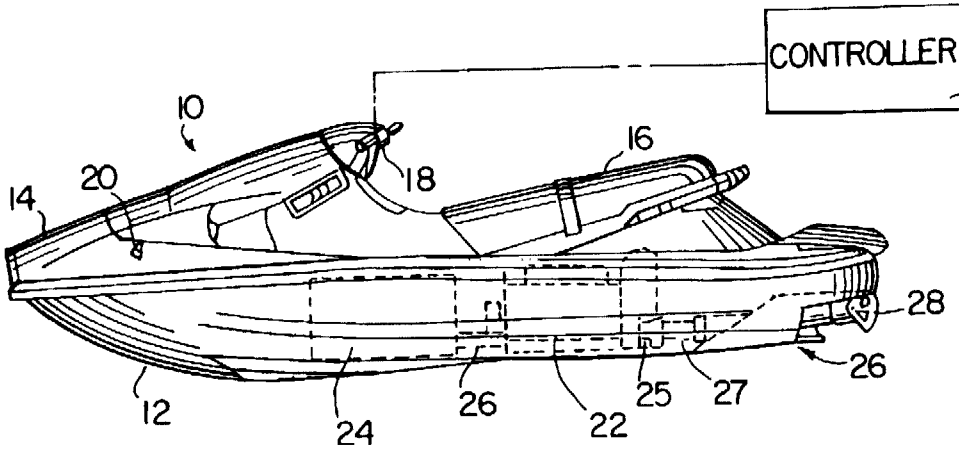
FIG. 1 is a schematic view of a personal watercraft having a brake in accordance with the invention.

FIG. 1 shows a personal watercraft 10. The watercraft 10 has a hull 12, and a deck 14, both preferably made of fiber reinforced plastic. A driver and/or passenger riding on the watercraft 10 straddles the seat 16. The driver steers the watercraft 10 using a steering assembly 18 which is located forward of the seat 16. An engine compartment 20 is located between the hull 12 and the deck 14. A gasoline fueled internal combustion engine 22 is located within the engine compartment 20. A fuel tank 24 is located in the engine compartment 20 forward of the engine 22. The engine 22 receives fuel from the fuel tank 24 from a fuel line 26. Engine 22 has an output shaft 25 that is coupled via coupler 27 to a jet pump located rearward of the engine 22 generally in the vicinity of arrow 26. The engine 22, the coupler 27, and the jet pump 26 provide a unidirectional drive for the watercraft. The watercraft 10 includes a reverse gate 28 rearward of the jet pump 26 that can be positioned rearward of the jet pump 26 to provide reverse propulsion for the watercraft 10, or braking thrust when the watercraft is moving in the forward direction. When the reverse gate 28 is located in an up position, the pump 26 provides forward thrust for the watercraft 10. Neutral thrust can be achieved by positioning the reverse gate 28 between the forward and reverse positions. In accordance with the invention, an electronic controller 30 controls the position of the reverse gate 28.

Figure 2:
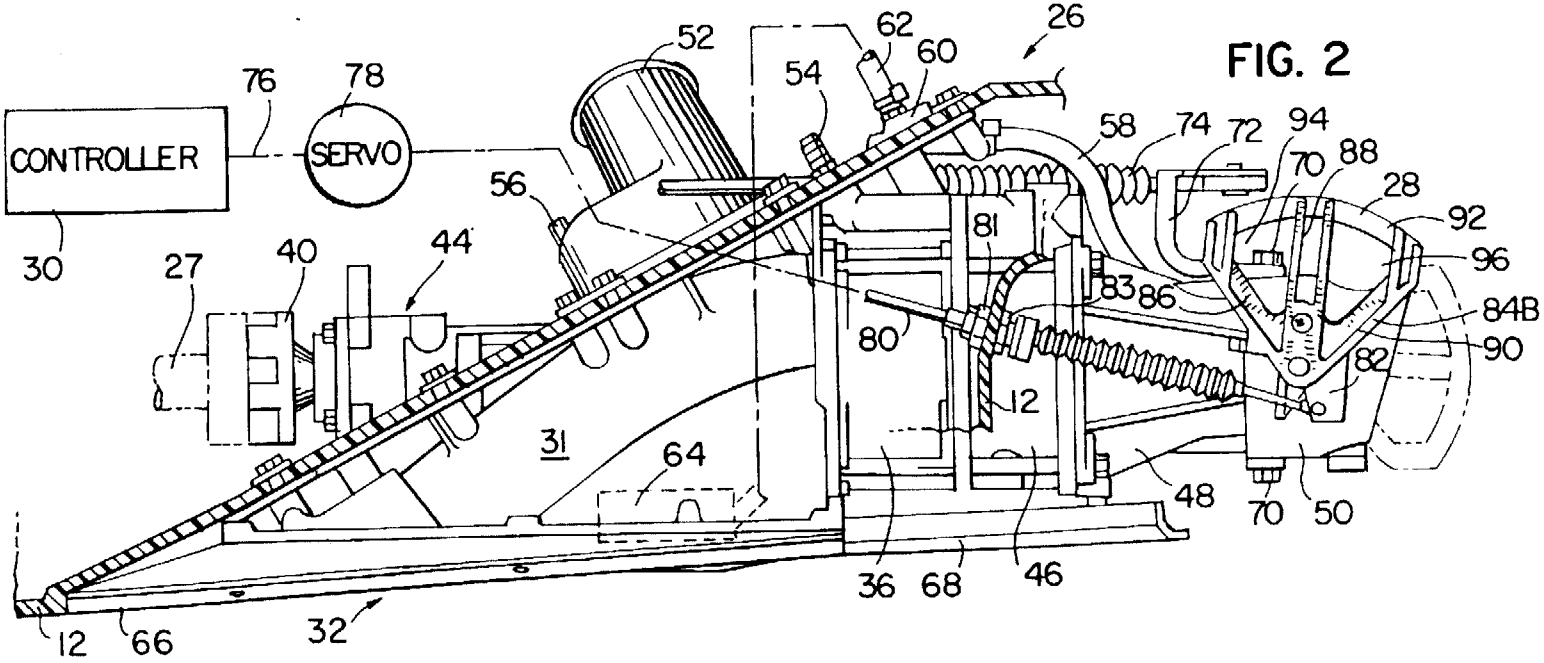
FIG. 2 is a side view of a jet pump having a reverse mechanism and a brake in accordance with the invention.

FIG. 2 shows the jet pump 26 in more detail. The pump 26 includes an intake housing 31 that is attached to the hull 12. The intake housing 31 has an inlet opening 32 that provides a path for sea water to flow into an intake duct 34 located within the intake housing 31. Sea water flows upward and rearward through the intake duct 34 to an impeller located within a wear ring 36. The impeller is rotatably driven by an impeller drive shaft. The preferred impeller mounting system is described in detail in copending patent application, Ser. No. 08/719,621 filed Sep. 25, 1996, entitled "Impeller Mounting System For A Personal Watercraft", by James R. Jones, and assigned to the assignee of the present application. The impeller drive shaft passes through an impeller drive shaft opening in the intake housing 31. A coupling head 40 is attached to the impeller drive shaft. The coupling head 40 for the impeller drive shaft is driven by the coupler 27 which in turn in driven by the engine output shaft 25. As the impeller shaft passes through the intake housing 31, the impeller shaft is supported by a sealed bearing assembly 44. The preferred intake housing 31 as well as the preferred sealed bearing assembly 44 are described in detail in copending patent application, Ser. No. 08/710,868 filed Sep. 28, 1996, entitled "Intake Housing For Personal Watercraft", by James R. Jones, and assigned to the assignee of the present application.

An exhaust adapter 52 is mounted to the top surface of the inlet housing 31. Exhaust adapter 52 receives engine exhaust from the engine 22 and guides the exhaust into the intake housing 31 around the intake duct. Cooling water is fed to the engine 22 from the stator 46 through a nipple 54 and returns from engine 22 to the exhaust adapter 52 through nipple 56. A siphoning tube 58 is connected through the top of the intake housing 31 using fitting 60. A baling tube 62 attached to fitting 60 is connected to a bilge member 64 having a screened opening located in the bilge of the watercraft 10. A siphon break is preferably provided in the baling tube 62 to prevent the watercraft 10 from inadvertently flooding when the watercraft 10 is at rest.

A stator 46 is located rearward of the impeller and the wear ring 36. The stator 46 has several stationary vanes, preferably seven (7) vanes, to remove swirl from the accelerated sea water. When the sea water exits the stator 46, it flows through a nozzle 48. The preferred construction for the stator 46 and the nozzle 48 is described in detail in copending U.S. patent application, Ser. No. 08/710,869 filed Sep. 23, 1996, entitled "Stator And Nozzle Assembly For Jet Propelled Personal Watercraft", by James R. Jones, and assigned to the assignee of the present application, which is herein incorporated by reference.

An inlet adapter plate 66 is connected to the intake housing 31 upstream of the intake duct to adapt the intake housing 31 to the hull 12 on the underside of the watercraft 10. A tine assembly (not specifically shown) has a plurality of tines that extend rearward from the inlet adapter 66 to cover the inlet opening 32. A ride plate 68 is mounted to the inlet adapter 66 rearward of the inlet opening 32. The ride plate 68 covers the area rearward of the inlet opening 32 to the transom of the watercraft 10 so that the pump components are not exposed below the watercraft 10. The ride plate 68 is supported in part by a depending boss (not shown) on the nozzle 48. The preferred inlet adapter system, including the inlet adapter plate 66, the tine assembly, and the ride plate 68 are disclosed in detail in copending patent application, Ser. No. 08/717,915 filed Sep. 23, 1996, now U.S. Pat. No. 5,700,169, entitled "Inlet Adapter System For A Personal Watercraft", by James R. Jones, and assigned to the assignee of the present application, which is herein incorporated by reference.

Sea water exiting the nozzle 48 is directed by rotating rudder 50 about a vertical axis to steer the personal watercraft 10. The tubular rudder 50 is attached to the nozzle 48 using mounting bolts 70 to rotate about the vertical steering axis. The tubular rudder 50 includes a steering actuating arm 72 that can be moved to rotate the tubular rudder 50 about the vertical steering axis. A steering actuation cable 74 is connected to the steering actuating arm 72. The steering actuating cable 74 is actuated by movement of the steering assembly 18, FIG. 1, when the driver of the watercraft 10 moves the handlebars.

The reverse gate 28 is mounted to rotate about a horizontal axis, preferably to flanges on the nozzle 48 in the embodiment shown in FIG. 2. The electronic controller 30 outputs a reverse gate control signal in line 76 to servomotor 78. The servomotor 78 receives the reverse gate control signal and mechanically moves a reverse gate control cable 80 in accordance with the reverse gate control signal in line 76. The reverse gate control cable 80 passes through the hull 12 and is connected to a reverse gate actuating arm 82 on the reverse gate 28. The reverse gate control cable 80 is pivotally attached to the reverse gate actuating arm 82. The aft end of the reverse gate control cable 80 has an eyelet 116 that is secured to a pin 118 through an opening in the actuating arm 82 on the reverse gate 28. Fittings 81 and 83 are used to secure the reverse gate control cable 80 as it passes through the hull 12. When the servomotor 78 pushes the reverse gate control cable 80 rearward, the reverse gate 28 rotates counter-clockwise to the full-up position, FIG. 5. When the servomotor 78 pulls the reverse gate control cable 80 fully forward, the reverse gate 28 rotates clockwise to a fully down position, FIG. 6. The servomotor 78 can also move the reverse gate control cable 80 to position the reverse gate 28 in a neutral position, FIGS. 4 and 5, or to a partially down position (e.g., between neutral and fully down), if desired. Alternatively, a sealed servomotor can be attached to the pump outside of the hull, and the sealed servomotor can be used to drive a linkage attached to the reverse gate.

As explained above, the reverse gate 28 should embody several characteristics to enable effective braking. It is desirable that the steering direction and characteristics of the watercraft 10 be consistent when the watercraft is accelerating with the reverse gate 28 in the full-up position, or when the watercraft 10 is decelerating with the reverse gate in a full-down, neutral, or partial-down position. It is also desirable that the reverse gate 28 does not provide excessive reverse or braking thrust when the watercraft 10 is traveling forward at high speeds. Excessive reverse thrust can cause the aft portion of the watercraft 10 to rise and the bow to drop, thereby possibly causing an unstable condition. The preferred reverse gate 28 has the above characteristics, and is disclosed in copending patent application, Ser. No. 08/783,440 filed Jan. 16, 1997, entitled "Reverse Gate For Personal Watercraft", by James R. Jones, Peter Grinwald and Richard Christians, and assigned to the assignee of the present application which is herein incorporated by reference.

Note that the watercraft 10 is capable of "off-throttle steering" when the watercraft 10 is moving in the forward direction and the reverse gate 28 is in a full-down or neutral position, even if throttle is not being applied (e.g., off-throttle steering during coast down). This occurs because ram pressure forces water through the jet pump 26 even during coats down, and water exiting the rotating rudder 50 if further deflected by the reverse gate 28 to provide lateral steering vectors.

A brief description of the reverse gate 28 follows with particular reference to FIGS. 2 and 3. The preferred reverse gate 28 has a starboard side support structure 84A and a port side support structure 84B. Each support structure 84A, 84B includes an upper radial support wall 86, a middle radial support wall 88, a lower radial support wall 90, and a lateral thrust control wall 92 which is attached to the peripheral end of the radial support walls 86, 88, and 89. The side support structures 84A, 84B thus include a first steering aperture 94 and a second steering aperture 96. The side support structures 84A, 84B are mounted about a horizontal reverse gate pivot axis using mounting bolts 98A, 98B. The mounting bolts 98A, 98B pass through openings 100A, 100B in the side support structures 84A, 84B and are secured in mounting flanges 102A, 102B extending from the nozzle 48. Bushings 104A and 104B are provided in the openings 100A, 100B in the side support structures 84A, 84B to facilitate rotation of the reverse gate 28 about the horizontal reverse gate pivot axis.

The reverse gate 28 includes a deflector plate 106 that spans between the peripheral edge of the starboard side support structure 84A and the peripheral edge of the port side support structure 84B. The deflector plate 106 has a deflector surface 108A, 108B that includes a vertical jet divide 110 equally spaced between the starboard side support structure 84A and the port side support structure 84B. The vertical jet divide separates the deflector surface 108A, 108B into a starboard side deflector surface 108A and a port side deflector surface 108B. Both the starboard side deflector surface 108A and the port side deflector surface 108B are formed in the shape of a simple-curve around a generally horizontal axis. In addition, both the starboard side deflector surface 108A and the port side deflector surface 108B are slanted inward and meet at a central apex 110 along the deflector surface to form the vertical jet divide 110.

When the reverse gate 28 is positioned rearward of the rudder 50, a portion of the jet of water exiting the rudder outlet 112 is redirected forward of the rudder 50 by the deflector surface 108A, 108B to provide reverse or braking thrust, and a portion of the jet of water from the rudder outlet 112 is deflected laterally through the steering apertures 94, 96 in the starboard side support structure 84A and laterally through the steering apertures 94, 96 in the port side support structure 84B proportionally in accordance with the orientation of the rudder 50. The portion of the jet of water exiting through the steering apertures 94, 96 in the side support structures 84A, 84B of the reverse gate 28 provide lateral thrust steering vectors. The combined lateral steering thrust to the starboard and to the port when the reverse gate is down or partially down is proportionally greater than the amount of lateral steering thrust that would be present if the reverse gate 28 were in the full-up position. In addition, allowing a portion of the jet flow to exit laterally through the steering apertures 94, 96 relieves pressure at the deflector surface 108A, 108B and rearward of the rudder 50 which allows the pump 26 to run at higher speeds before stalling occurs. Moreover, by allowing a portion of the jet flow from the rudder outlet 112 to escape laterally, the reverse gate 28 does not provide as much immediate reverse or braking thrust when the reverse gate 28 is initially dropped as with other reverse gates. This feature helps to initiate lift of the stern of the watercraft 10 when the reverse gate 28 is fully dropped when the watercraft 10 is moving forward at high speeds. If the driver of the watercraft 10 desires additional braking thrust after the reverse gate 28 is initially lowered, the driver can accelerate the jet pump 26 as is described in conjunction with FIGS. 4–7.

The curvature radius of the starboard side deflector surface 108A and the port side deflector surface 108B are each preferably constant and each preferably equal to the distance of the outer intersecting edge 114A, 114B of the deflector surface 108A, 108B of the side support structure 84A, 84B to the horizontal reverse gate pivot axis passing through mounting bolts 98A, 98B. However, both the starboard side deflector surface 108A and the port side deflector surface 108B slant inward towards the horizontal reverse gate pivot axis as the deflector surface 108A, 108B extends from each intersecting edge 114A, 114B towards the vertical jet divide 110. It is preferred that the sides of the deflector surface 108A, 108B slant in symmetrically at about 7°. The starboard side lateral thrust control wall 92 on the starboard side support structure 84A and the port side lateral thrust control wall 92, the port side support structure 84B, extend inward from the edge 114A, 114B of the sides 108A, 108B of the deflector surface towards the horizontal reverse gate pivot axis. It is preferred that the thrust control wall 92 on the starboard side support structure 84A be symmetric with the thrust control wall 92 on the port side support structure 84B. Further, it is preferred that the lateral thrust control walls 92 be sized so that the amount of reverse thrust from the jet of water deflected from the deflector plate 106 be approximately equal to one-half of the combined amount of lateral thrust to the starboard side and to the port side when the rudder 50 is directed straight rearward.

Referring to FIGS. 4–7, in accordance with the invention, the brake mechanism includes a forward throttle control mechanism 120 and a brake control mechanism 122. The throttle control mechanism 120 throttles the engine 22 and also outputs a forward throttle signal in line 124 which is transmitted to the electronic controller 30. The brake control mechanism 122 also throttles the engine 22, but outputs a brake signal in line 142 that is transmitted to the electronic controller 30.

The throttle control mechanism 120 preferably includes an actuator 126 (e.g., a hand lever) that is mounted to the handlebar on the steering assembly 18 so that a driver gripping hand grip 128 can squeeze the actuator 126 to actuate the throttle control mechanism 120. When the operator squeezes the throttle control actuator 126 closed or partially closed, FIG. 5, the actuator 126 mechanically moves a primary throttle cable 130 to throttle the engine 22. A switch 132 detects displacement of the primary throttle cable 130 and outputs a logical high forward throttle signal in line 124 when the actuator 126 is not in a fully open position. The primary throttle cable 130 mechanically throttles the engine in proportion to the position of the actuator 126 for the forward throttle control mechanism 120. If the engine 22 is a carbureted engine, the primary throttle cable 130 should control the carburetor to throttle the engine. The invention is not, however, limited to carbureted engines. For instance, the actuator 126 may mechanically actuate a primary throttle cable to position a throttle body in a fuel injected engine, or may even provide an electrical signal in proportion with the position of the actuator 126 to a computer or the like which in turn throttles the engine.

The brake control mechanism 122 includes an actuator 134 (e.g., a hand lever) that is preferably mounted to the handlebar on the steering assembly 18 for the watercraft 10 adjacent a hand grip 136 for the left hand of the driver of the watercraft 10. The actuator 134 can be squeezed partially or fully closed from an open position, FIG. 6, to mechanically move a secondary throttle cable to throttle the engine 22. A switch 140 detects mechanical movement of the secondary throttle 138 and outputs a logical brake signal in line 142 to electronic controller 30 when the actuator 134 is not in a fully open position. The secondary throttle cable 138 mechanically throttles the engine in proportion to the position of the actuator 134 for the brake control mechanism 122. As with the throttle control mechanism 120, the brake control mechanism 122 mechanically throttles a carbureted engine by mechanically positioning the carburetor, or would mechanically throttle a fuel injection engine by mechanically positioning the throttle body. However, the invention is not be limited to mechanical means for throttling the engine, for instance, the actuator 134 for the brake control mechanism 122 could provide an electrical signal in proportion to the position of the actuator 134 and still come within the scope of the invention.

FIG. 8 illustrates the preferred control scheme used by the electronic controller 30 to determine the position of the reverse gate 28. In accordance with the control scheme shown in FIG. 8, the position of the reverse gate 28 is adjusted depending both on an initial state of the forward throttle signal in line 124 and the brake signal in line 142, and a subsequent state to which the forward throttle signal in line 124 and the brake signal in line 142 are changed. In FIG. 8, "0" represents that the actuator 126 or 134 is in a fully open position, and "1" represents that the actuator is at least partially closed.

When actuators 126 and 134 are fully open, FIG. 4, it is preferred that the reverse gate 28 be located in a neutral position as shown in FIG. 4. Note that in FIG. 4, the engine 22 and the jet pump 26 are idling and there is only very little flow exiting the outlet 112 of the rudder 50. Nonetheless, because the watercraft 10 will often be at rest when the actuator 127 and 134 are fully open, it is desirable to have the reverse gate 28 in a neutral position so that any forward thrust (arrow 144) is counteracted by reverse thrust (arrow 146).

Figure 5:
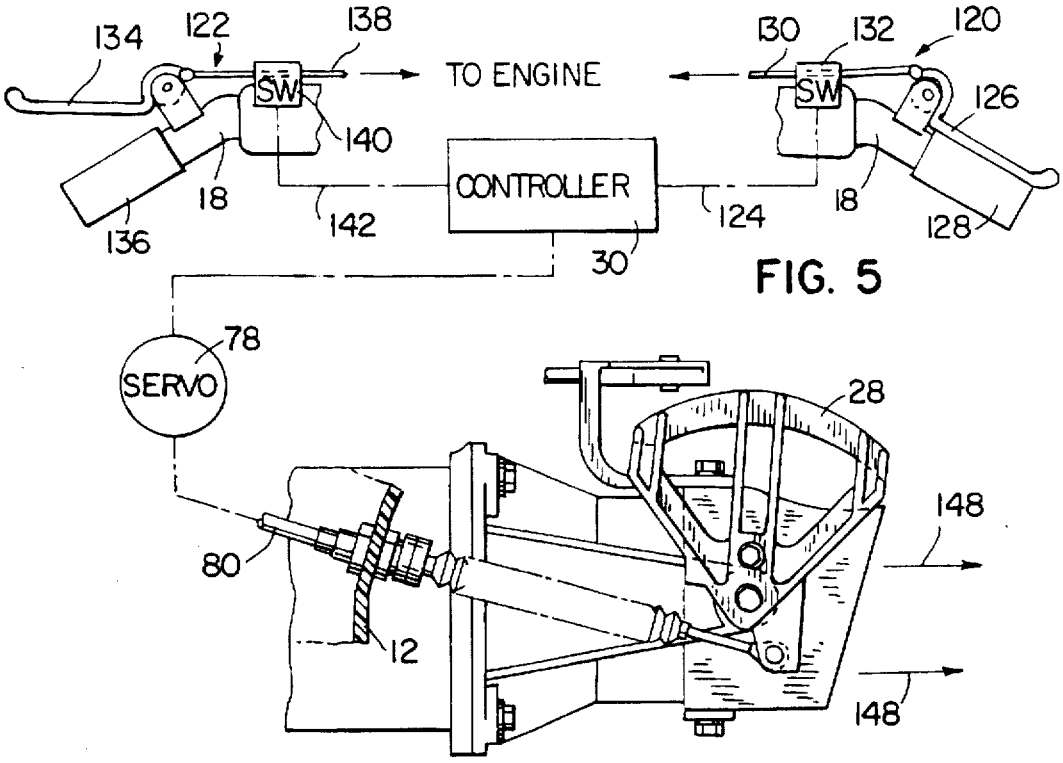
FIG. 5 is a schematic illustration of the brake mechanism in which an actuator for the brake mechanism is in a fully open position and an actuator for the forward throttle mechanism is an a closed position.
Figure 6:
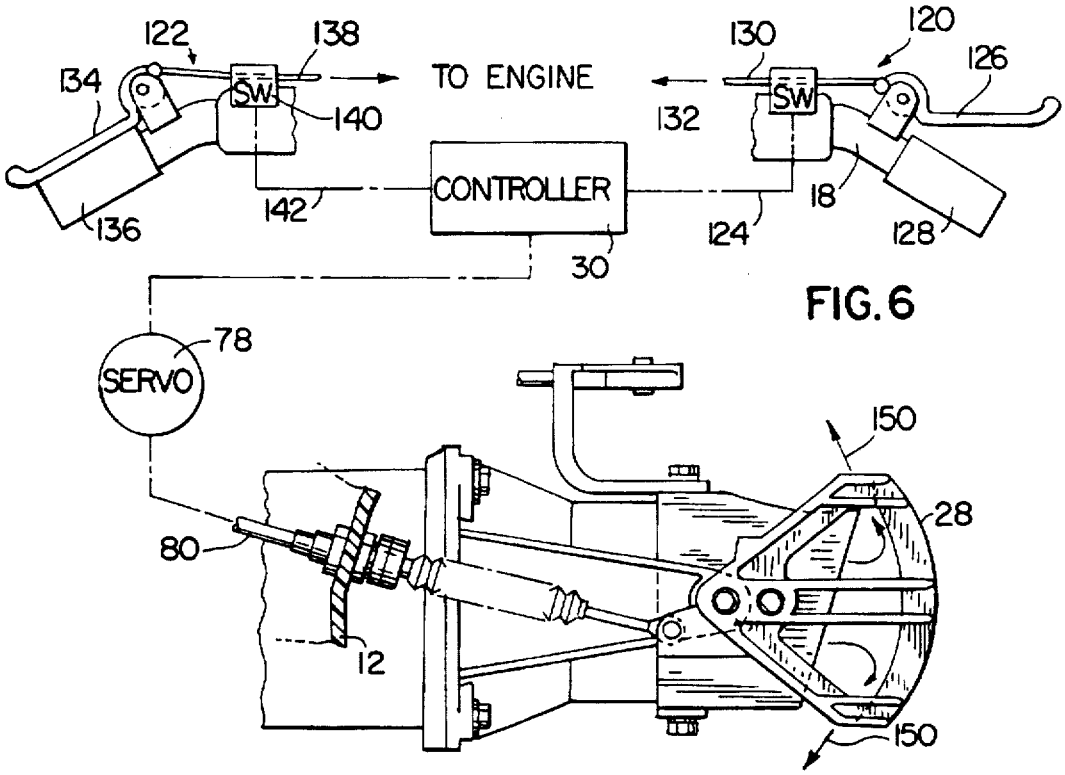
FIG. 6 is a schematic illustration of the brake mechanism in which an actuator for the brake mechanism is in an closed position and an actuator for the forward throttle mechanism is in a fully open position.

Row numbers 1, 2 and 10 in FIG. 8 indicate the effect of subsequent closing or partially closing the throttle actuator 126, the brake actuator 134, or both 126 and 134, respectively, after both actuators 126, 134 have been fully open. Row 1 indicates that the reverse gate 28 is shifted to a full-up position when the actuator 126 for the forward throttle mechanism 120 is closed or partially closed, and the actuator 134 for the brake mechanism 122 remains open. FIG. 5 shows this scenario and illustrates that this scenario results in forward thrust for the watercraft 10 as depicted by arrows 148. Row 2 in FIG. 8 indicates that the reverse gate 28 is positioned in a full-down position when the actuator 134 for the brake mechanism 122 is closed or partially closed and the actuator 126 for the forward throttle mechanism 120 remains fully open. FIG. 6 shows this scenario and illustrates that this scenario results in reverse or braking thrust as depicted by arrows 150. If the watercraft 10 is stationary or moving rearward, the reverse thrust 150 shown in FIG. 6 will move the watercraft 10 rearward. However, if the watercraft 10 is moving forward, the reverse thrust 150 will act as a braking thrust to slow the forward movement of the watercraft. Row 10 in FIG. 8 indicates that the reverse gate 28 remains in a neutral position when the actuator 126 for the forward throttle mechanism 120 and the actuator 134 for the brake mechanism 122 are contemporaneously closed.

Figure 7:
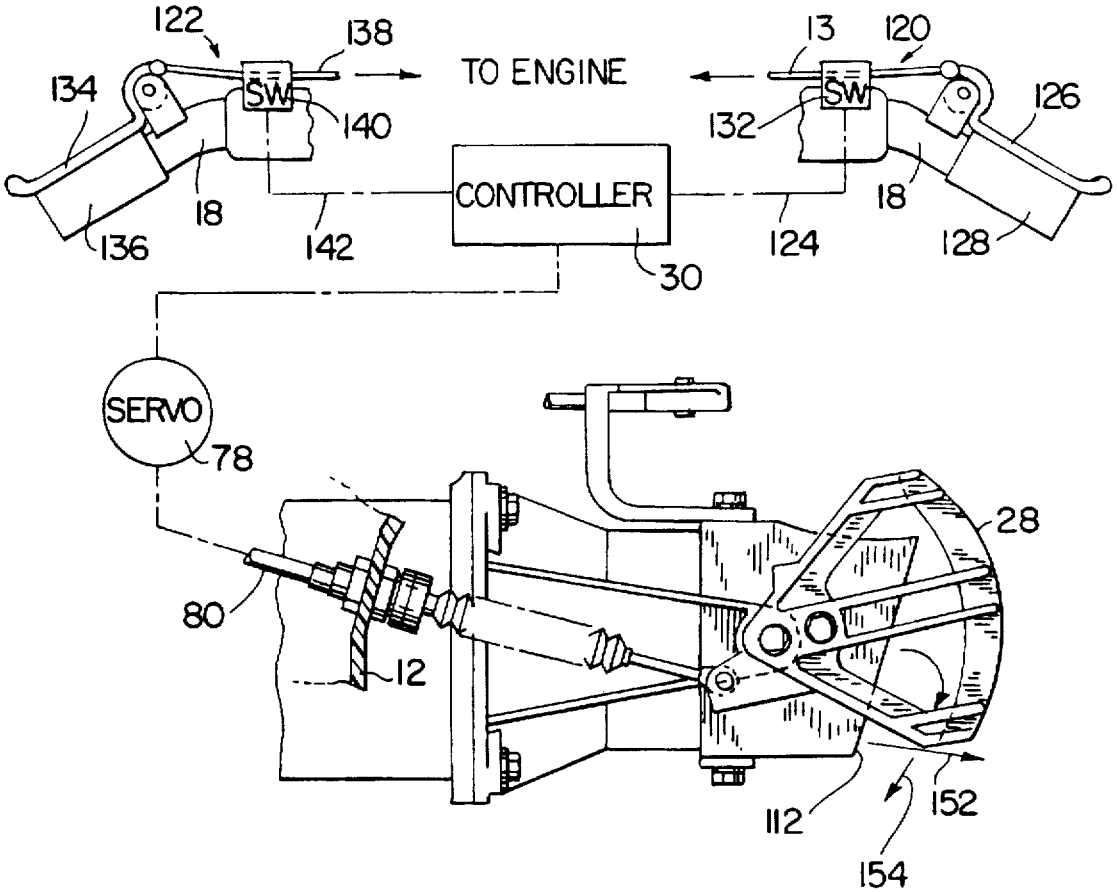
FIG. 7 is a schematic illustration of the brake mechanism in which an actuator for the brake mechanism is in an closed position and an actuator for the forward throttle mechanism is an a closed position.

Rows 3 and 4 in FIG. 8 indicate that the reverse gate 28 is moved to a neutral position when the actuator 126 for the forward throttle mechanism 120 is initially closed or partially closed and the actuator 134 for the brake mechanism 122 is initially fully open, and subsequently either the actuator 134 for the brake mechanism 122 is closed or partially closed, FIG. 7, or the actuator 126 for the forward throttle mechanism 120 is fully open, FIG. 4. However, Row 9 in FIG. 8 indicates that contemporaneously opening the actuator 126 for the forward throttle mechanism 120 and closing or partially closing the actuator 134 for the brake mechanism 122 results in positioning the reverse gate 28 in the full-down position, thus providing reverse and/or braking thrust. As described above, FIG. 4 illustrates the reverse gate 28 in a neutral position when the watercraft 10 is idling. On the other hand, FIG. 7 illustrates the reverse gate 28 in a neutral position, but the engine 22 is operating to provide a jet flow from the rudder outlet 112 in proportion to the position of the actuators 126 and 134. Because of the position of the reverse gate 28, forward thrust from the rudder outlet 112 (arrow 152) is counteracted by reverse thrust 154 from the reverse gate 28, thus resulting in neutral forward thrust. However, the scenario shown in FIG. 7 is useful when the driver desires to maneuver the watercraft 10 by turning the rudder 50 as shown in FIG. 3, even when there is neutral forward thrust.

Rows 5 and 6 in FIG. 8 indicate that the reverse gate 28 is moved to a neutral position when initially the actuator 126 for the forward throttle mechanism 120 is fully open and the actuator 134 for the brake mechanism 122 is closed or partially closed (FIG. 6), and subsequently, the actuator 134 for the brake mechanism 122 is fully open (FIG. 4) or the actuator 126 for the forward throttle mechanism 120 is closed or partially closed (FIG. 7).

Row 7 in FIG. 8 indicates that it is desirable for the reverse gate 28 to be moved to a full-up position (FIG. 5) when both the actuators 126 and 134 are initially closed or partially closed (FIG. 7), and subsequently, the actuator 134 for the brake mechanism 122 is fully open, and the actuator 126 for the forward throttle mechanism 120 remains closed or partially closed. As shown in FIG. 5, this results in forward thrust for the watercraft 10 as depicted by arrows 148.

Row 8 in FIG. 8 indicates that the reverse gate 28 is moved to a down position to provide reverse/braking thrust when initially both the actuator 126 for the forward throttle mechanism 120 and the actuator 134 for the brake mechanism 122 are closed or partially closed (FIG. 7), and subsequently, the actuator 126 for the forward throttle mechanism 120 is fully opened and the actuator 134 for the brake mechanism 122 remains closed or partially closed.

Row 12 in FIG. 8 indicates that the reverse gate 28 is moved to a neutral position to provide neutral thrust when both the actuator 126 and for the forward throttle mechanism 120 and the actuator 134 for the brake mechanism 122 are closed or partially closed, and subsequently, the actuator 126 for the forward throttle mechanism 120 and the actuator 134 for the brake mechanism 122 are contemporaneously opened.

Row 11 in FIG. 8 indicates that the reverse gate 28 is moved to a full-up position to provide forward thrust when initially the actuator 126 for the forward throttle mechanism 120 is open and the actuator 134 for the brake mechanism is closed or partially closed, and subsequently the actuator 126 for the forward throttle mechanism 120 is closed and contemporaneously the actuator 134 for the brake mechanism 122 is opened.

To summarize the control scheme in FIG. 8, the reverse gate 28 is moved to a full-up position when the actuator 134 for the brake mechanism 122 is in a fully open position and the actuator 126 for the forward throttle mechanism 120 is in a closed or partially closed position. The reverse gate 28 is moved to a full-down position when the actuator 126 for the forward throttle mechanism 120 is in a fully open position and the actuator 134 for the brake mechanism 122 is in a closed or partially closed position. Otherwise, the reverse gate 28 is moved to a neutral position when the state of the actuators 126 and 134 changes. Under some circumstances, it may be desirable to position the reverse gate 28 in a partial-down position (i.e. between the neutral position and the full-down position) although this is not shown in FIG. 8. For instance, it may be desirable to modify the control scheme in FIG. 8 by changing Row 2 to indicate that the reverse gate is positioned between the neutral position and the full-down position when the actuator 126 for the forward throttle mechanism 120 remains in the fully open position and the actuator 134 for the brake mechanism 122 is actuated from a fully open position to a closed or partially closed position.

A driver operating the watercraft 10 thus has the ability to steer the watercraft 10 when the reverse gate 28 is in the neutral or down positions, and also has the ability to intensify forward braking thrust by proportionally closing actuator 134 for the brake mechanism 120.

It is realized that there may be various alternatives, modifications and equivalents of the invention which are possible yet in accordance with the true spirit of the invention. Such modifications, alternatives and equivalents should be considered to fall within the scope of the following claims.

For instance, the control scheme used by the electronic controller 30 as illustrated in FIG. 8 to determine the position of the reverse gate 28 may be modified depending upon the nature of the personal watercraft and the desired braking performance. In particular, the "EFFECT" listed for columns 3, 4, 6 10 and 12 may be changed from "Neutral Position -- Neutral" to "Gate Down -- Reverse/Brake" on certain personal watercraft without compromising performance. In certain applications, this may indeed be preferred over the scheme illustrated explicitly in FIG. 8 due to less transom lift at medium or high forward watercraft speeds, and small operational differences at idle.

I claim:

1. In a jet propelled watercraft having a jet pump with a nozzle, a rudder rotatably mounted about a vertical axis to direct a jet of water from the nozzle and steer the watercraft, and a reverse gate rotatably mounted about a fixed horizontal pivot axis that can be positioned in a full-up position for forward propulsion and in a full-down position for rearward propulsion, a brake mechanism comprising:

a forward throttle control mechanism that throttles the engine and also outputs a forward throttle signal;

a brake control mechanism that throttles the engine and also outputs a brake signal;

an electronic controller that inputs the forward throttle signal and the brake signal and outputs a reverse gate control signal; and a motor that inputs the reverse gate control signal and mechanically moves a reverse gate control cable connected to the reverse gate in response to the reverse gate control signal.

2. A brake mechanism as recited in claim 1 wherein:

the brake control mechanism includes an actuator that can be squeezed closed or partially from an open position to mechanically move a secondary throttle cable to throttle the engine, and a switch that outputs the brake signal when the actuator for the brake control mechanism is not in the open position; and the forward throttle control mechanism includes an actuator that can be squeezed closed or partially closed from an open position to mechanically move a primary throttle cable to throttle the engine, and a switch that outputs the forward throttle signal when the actuator for the forward throttle control mechanism is not in the open position.

3. A brake mechanism as recited in claim 2 wherein the electronic controller includes:

means for positioning the reverse gate in a neutral position when the actuator for the brake mechanism is in an open position and the actuator for the forward throttle mechanism is in an open position.

4. A brake mechanism as recited in claim 2 wherein the electronic controller includes:

means for positioning the reverse gate in a full-down reverse position when the actuator for the brake mechanism is in an open position and the actuator for the forward throttle mechanism is in an open position.

5. A brake mechanism as recited in claim 2 wherein the electronic controller includes:

means for positioning the reverse gate in a neutral position when the actuator for the brake mechanism is in a closed or partially closed position and the actuator for the forward throttle mechanism is in a closed or partially closed position.

6. A brake mechanism as recited in claim 2 wherein the electronic controller includes:

means for positioning the reverse gate in a full-down reverse position when the actuator for the brake mechanism is in a closed or partially closed position and the actuator for the forward throttle mechanism is in a closed or partially closed position.

7. A brake mechanism as recited in claim 2 wherein the electronic controller includes:

means for positioning the reverse gate in a full-up forward position when the actuator for the brake mechanism is in an open position and the actuator for the throttle mechanism is in a closed or partially closed position.

8. A brake mechanism as recited in claim 2 wherein the electronic controller includes means for positioning the reverse gate in a full-down reverse position when the actuator for the throttle mechanism is in an open position and the actuator for the brake mechanism is actuated from an open position to a closed or partially closed position.

9. A brake mechanism as recited in claim 2 wherein the electronic controller includes means for positioning the reverse gate in a position between a neutral position and a full-down reverse position when the actuator for the throttle mechanism is an open position and the actuator for the brake is actuated from an open position to a closed or partially closed position.

10. A brake mechanism as recited in claim 2 wherein the electronic controller includes means for positioning the reverse gate in a neutral position when the actuator for the brake mechanism is in a closed or partially closed position and the actuator for the forward throttle mechanism is opened from a closed or partially closed position to the open position.

11. A brake mechanism as recited in claim 1 wherein the reverse gate includes:

a port side support structure mounted to rotate about the horizontal pivot axis;

a starboard side support structure mounted to rotate about the horizontal pivot axis;

a deflector plate that spans between the port side support structure and the starboard side support structure, the deflector plate having a deflector surface that has a vertical jet divide equally spaced between the port side support structure and the starboard side support structure to separate the deflector surface into a port side deflector surface and a starboard side deflector surface, each side of the deflector surface being formed in the shape of a simple curve;

wherein the reverse gate can be actuated to position the reverse gate rearward of the rudder so that a portion of the jet of water is redirected forward of the rudder and a portion of the jet of water is deflected laterally to port and laterally to starboard proportionally in accordance with the orientation of the rudder.

12. A brake mechanism as recited in claim 11 wherein the port side support structure and the starboard side support structure each have a steering aperture therethrough, and the laterally deflected portion of the jet flows through the steering apertures proportionally in accordance with the orientation of the rudder.

13. A brake mechanism as recited in claim 11 wherein an outer intersecting edge of the deflector surface adjacent the port side support structure and an outer intersecting edge of the deflector surface adjacent the starboard side support structure each have a curvature radius approximately equal to the distance of the intersecting edges from the horizontal pivot axis; and the deflector surface gradually approaches closer to the horizontal pivot axis as the deflector surface extends from each intersecting edge towards the vertical jet divide.

14. A brake mechanism as recited in claim 11 wherein the reverse gate further comprises:

a port side lateral thrust control wall, the port side lateral thrust control wall extending away from a port edge of the port side deflector surface in the direction of the horizontal pivot axis; and a starboard side lateral thrust control wall, the starboard side lateral thrust control wall extending away from a starboard edge of the starboard side deflector surface in the direction of the horizontal pivot axis.

15. A brake mechanism as recited in claim 14 wherein the reverse gate is rotatably mounted to the nozzle.

16. A brake mechanism as recited in claim 15 wherein the nozzle includes a port side mounting flange and a starboard side mounting flange, and the port side support structure of the reverse gate is rotatably mounted to the port side mounting flange and the starboard side support structure of the reverse gate is rotatably mounted to the starboard side mounting flange.

17. A brake mechanism as recited in claim 11 wherein the nozzle has an outlet and the horizontal pivot axis passes rearward of the nozzle outlet.

18. A brake mechanism as recited in claim 11 wherein the port side deflector surface and the starboard side deflector surface both slant inward and meet at a central vertical apex along the deflector surface.

19. A brake mechanism as recited in claim 18 wherein the curvature radius for both the port side deflector surface and the starboard side deflector surface are substantially constant and are substantially equal to the distance of the peripheral edges of the port side deflector surface and the starboard side deflector surface to the horizontal pivot axis.

20. A brake mechanism as recited in claim 1 wherein the reverse gate includes:

a port side support structure mounted to rotate about the horizontal pivot axis;

a starboard side support structure mounted to rotate about the horizontal pivot axis; and a deflector plate that spans between the port side support structure and the starboard side support structure, the deflector plate having a deflector surface being defined by a simply-curved port side deflector surface and a simply-curved starboard side deflector surface both of which are slanted inward and which meet at a central apex along the deflector surface.

21. A reverse mechanism as recited in claim 20 wherein the curvature radius for both the port side deflector surface and the starboard side deflector surface is substantially constant and is substantially equal to the distance of the outer edges of the port side deflector surface and the starboard side deflector surface to the fixed horizontal pivot axis.

22. A brake mechanism as recited in claim 21 wherein the forward throttle mechanism includes a hand lever assembly mounted to the handlebar of the steering assembly for the watercraft.

23. A brake mechanism as recited in claim 1 wherein the brake mechanism includes a brake hand lever mounted on a handlebar for a steering assembly for the watercraft.

24. A brake mechanism as recited in claim 1 in which the motor is a servo motor that can move the reverse gate control cable over a limited range of motion.

25. A brake mechanism as recited in claim 1 in which the motor can position the reverse gate full-up position for forward propulsion, a full-down reverse position for rearward propulsion, and a neutral position in which the reverse gate is positioned between the full-up position and the full-down position so that thrust in the forward direction is substantially equal to thrust in the reverse direction.

26. A brake mechanism as recited in claim 25 wherein the motor can also position the reverse gate in a partial reverse position which is located geometrically between the neutral position and the full-down position.

27. In a jet propelled watercraft having a jet pump with a nozzle, a rudder, and a reverse gate, a method of braking comprising the following steps:

positioning the reverse gate in a neutral position behind the rudder when an actuator for a brake mechanism is in an open position and an actuator for a forward throttle mechanism is in an open position;

positioning the reverse gate in a neutral position when the actuator for the brake mechanism is in a closed or partially closed position and the actuator for a forward throttle mechanism is in a closed or partially closed position;

positioning the reverse gate in a full-up forward position when the actuator for the brake mechanism is in an open position and the actuator for the throttle mechanism is in a closed or partially closed position; and positioning the reverse gate in a full-down reverse position when the actuator for the throttle mechanism is in an open position and the actuator for the brake mechanism is actuated from an open position to a closed or partially closed position.

28. A method as recited in claim 27 further comprising the step of:

positioning the reverse gate in a neutral position when the actuator for the brake mechanism is in a closed or partially closed position and the actuator for the throttle mechanism is opened from a closed or partially closed position to the open position.

29. A method as recited in claim 27 further comprising the step of:

positioning the reverse gate in a position between the neutral position and the full-down position when the actuator for the brake mechanism is in a closed or partially closed position and the actuator for the throttle mechanism is opened from a closed or partially closed position to the open position.

30. In a jet propelled watercraft having a jet pump with a nozzle, a rudder, and a reverse gate, a method of braking comprising the following steps:

positioning the reverse gate in a full-down reverse position behind the rudder when an actuator for a brake mechanism is in an open position and an actuator for a forward throttle mechanism is in an open position;

positioning the reverse gate in a full-down reverse position when the actuator for the brake mechanism is in a closed or partially closed position and the actuator for a forward throttle mechanism is in a closed or partially closed position;

positioning the reverse gate in a full-up forward position when the actuator for the brake mechanism is in an open position and the actuator for the throttle mechanism is in a closed or partially closed position; and positioning the reverse gate in a full-down reverse position when the actuator for the throttle mechanism is in an open position and the actuator for the brake mechanism is actuated from an open position to a closed or partially closed position.

31. A method as recited in claim 30 further comprising the step of:

positioning the reverse gate in a full-down reverse position when the actuator for the brake mechanism is in a closed or partially closed position and the actuator for the throttle mechanism is open from a closed or partially closed position to the open position.

* * * * *